US010378250B2

(12) United States Patent
Alacqua et al.

(10) Patent No.: US 10,378,250 B2
(45) Date of Patent: Aug. 13, 2019

(54) LOCK WITH EMERGENCY ACTUATOR

(71) Applicant: SAES GETTERS S.P.A., Lainate (IT)

(72) Inventors: Stefano Alacqua, Como (IT); Matteo Mazzoni, Milan (IT); Davide Frigerio, Inverigo (IT)

(73) Assignee: SAES GETTERS S.P.A., Lainate (IT)

( * ) Notice: Subject to any disclaimer, the term of this patent is extended or adjusted under 35 U.S.C. 154(b) by 303 days.

(21) Appl. No.: 15/305,086

(22) PCT Filed: Mar. 29, 2016

(86) PCT No.: PCT/EP2016/056755
§ 371 (c)(1),
(2) Date: Oct. 18, 2016

(87) PCT Pub. No.: WO2016/156283
PCT Pub. Date: Oct. 6, 2016

(65) Prior Publication Data

US 2018/0106079 A1 Apr. 19, 2018

(30) Foreign Application Priority Data

Apr. 1, 2015 (IT) ..... MI2015A0467

(51) Int. Cl.
*E05B 77/10* (2014.01)
*E05B 47/00* (2006.01)
(Continued)

(52) U.S. Cl.
CPC ..... *E05B 77/10* (2013.01); *E05B 17/0062* (2013.01); *E05B 47/0009* (2013.01);
(Continued)

(58) Field of Classification Search
CPC .... E05B 47/0009; E05B 51/005; E05B 77/10; E05B 77/12; E05B 81/14; E05B 81/82;
(Continued)

(56) References Cited

U.S. PATENT DOCUMENTS 3,744,832 A * 7/1973 Casey ..... A62C 2/12 292/101
4,012,066 A * 3/1977 Salvatore ..... E05B 65/104 292/341.13

(Continued)

FOREIGN PATENT DOCUMENTS

DE 202005004391 U1 * 7/2006 ..... E05B 77/00
DE 102008012260 A1 10/2008

(Continued)

OTHER PUBLICATIONS

Written translation of DE 202013007862 U1, 2018, pp. 1-47 (Year: 2018).*

(Continued)

*Primary Examiner* — Christine M Mills
(74) *Attorney, Agent, or Firm* — Steinfl + Bruno LLP

(57) ABSTRACT

A lock for closing a door with respect to a frame. The lock includes a lock body mounted on the door and a striker mounted on the frame, or vice versa. The lock body includes a catch element mounted so as to rotate between a striker keep position and a striker release position; elastic means suitable for driving the catch element from the striker keep position to the striker release position; a lever suitable for moving between two positions, a closing position in which it maintains the catch element in the striker keep position and an opening position in which it is disengaged from the catch element; and a service actuator suitable for applying a force f on the lever so as to bring it from the closing position to the opening position. The lock body further includes an emergency SMA actuator suitable for applying a force on the lever so as to bring it from the closing position to the opening position. The SMA actuator can apply a force higher than 100 N and including blocking means for allow- (Continued)

Figure 2:
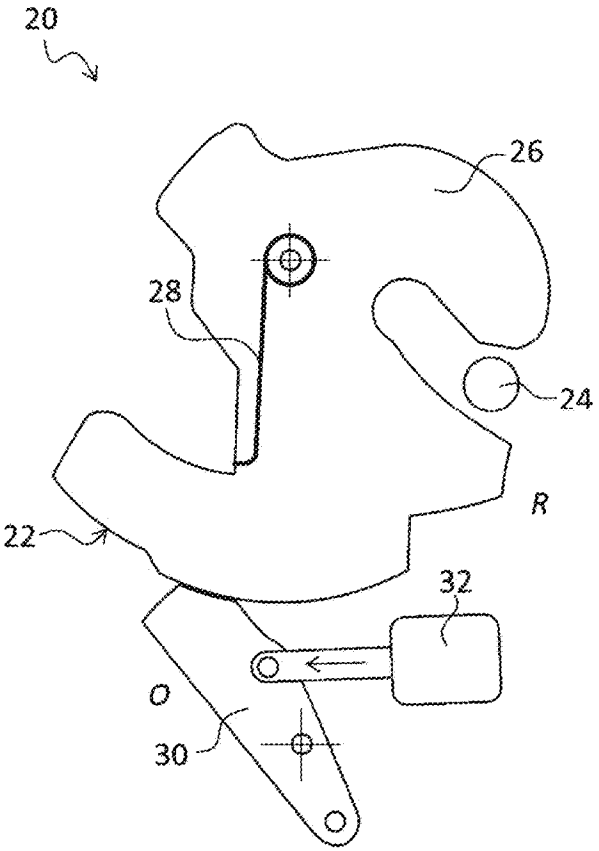
Fig. 2 PRIOR ART

ing the force to be applied on the lever only when the force exceeds a predetermined threshold value.

11 Claims, 5 Drawing Sheets

(51) Int. Cl.

| | |
|---|---|
| ***E05B 77/12*** | (2014.01) |
| ***E05B 81/14*** | (2014.01) |
| ***E05B 17/00*** | (2006.01) |
| *E05B 51/00* | (2006.01) |
| *E05B 81/82* | (2014.01) |
| *E05B 81/86* | (2014.01) |

(52) U.S. Cl.
CPC ..... *E05B 77/12* (2013.01); *E05B 81/14* (2013.01); *E05B 51/005* (2013.01); *E05B 81/82* (2013.01); *E05B 81/86* (2013.01)

(58) Field of Classification Search
CPC .... E05B 81/86; E05B 17/0062; E05B 65/104; Y10T 292/0908; Y10T 292/1082; Y10T 292/1047; Y10T 292/1075; Y10T 292/1083; Y10T 292/1084; Y10S 292/23; Y10S 292/66; Y10S 292/22
USPC ..... 292/92–94, 201, 216, 195, 202, 203, 292/DIG. 22, DIG. 23, DIG. 66
See application file for complete search history.

(56) References Cited

U.S. PATENT DOCUMENTS

| | | | | |
|---|---|---|---|---|
| 6,732,516 | B2 * | 5/2004 | Butera | E05B 47/0009 60/527 |
| 6,871,519 | B2 * | 3/2005 | Butera | E05B 47/0009 292/DIG. 25 |
| 8,066,462 | B2 * | 11/2011 | Rudduck | E05B 65/006 411/360 |
| 8,398,128 | B2 * | 3/2013 | Arabia | E05B 77/06 292/1 |
| 8,443,600 | B2 * | 5/2013 | Butera | F03G 7/065 60/528 |
| 8,505,987 | B2 * | 8/2013 | Browne | E05B 47/0009 292/201 |
| 8,801,053 | B2 * | 8/2014 | Alexander | E05B 47/0009 292/226 |
| 2003/0177974 | A1 * | 9/2003 | Dominique | E05B 85/107 116/200 |
| 2004/0104580 | A1 * | 6/2004 | Spiessl | D06F 37/42 292/84 |
| 2005/0062329 | A1 * | 3/2005 | Alacqua | B60N 2/20 297/378.12 |
| 2008/0217927 | A1 * | 9/2008 | Browne | E05B 47/0009 292/28 |
| 2010/0237632 | A1 | 9/2010 | Browne et al. | |
| 2013/0146382 | A1 | 6/2013 | Schoen | |
| 2014/0026679 | A1 * | 1/2014 | Mankame | F03G 7/065 73/862.53 |

FOREIGN PATENT DOCUMENTS

| | | | | |
|---|---|---|---|---|
| DE | 102012000913 | A1 * | 7/2013 | E05B 81/02 |
| DE | 202013007862 | U1 * | 12/2014 | E05B 47/0009 |
| EP | 1245762 | A1 * | 10/2002 | E05B 47/0009 |
| EP | 1279784 | A1 * | 1/2003 | E05B 47/0009 |
| EP | 1279784 | A1 | 1/2003 | |
| EP | 1300532 | A1 * | 4/2003 | E05B 47/0009 |
| EP | 2845973 | A2 | 3/2015 | |
| JP | 03180680 | A * | 8/1991 | |

OTHER PUBLICATIONS

International Search Report and Written Opinion for International Application No. PCT/EP2016/056755 filed Mar. 29, 2016 on behalf of SAES Getters S.P.A. dated Jul. 26, 2016. 12 pages.

* cited by examiner

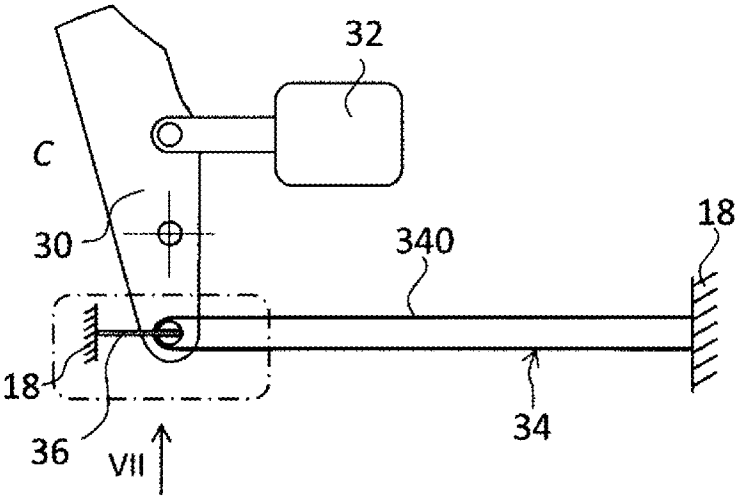
Fig. 6
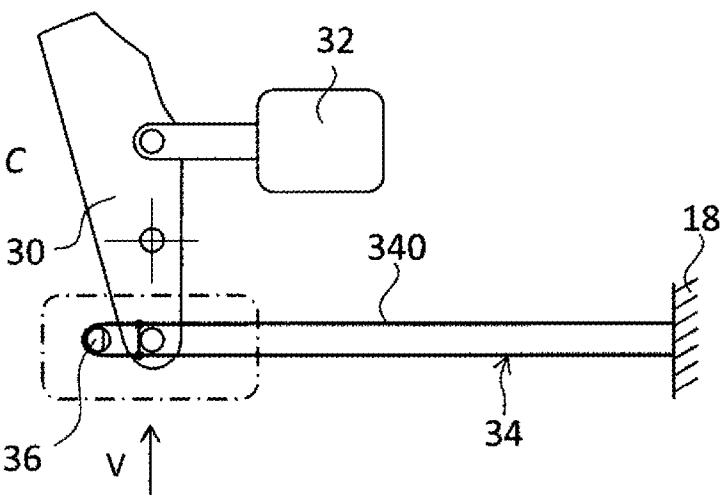
Fig. 4
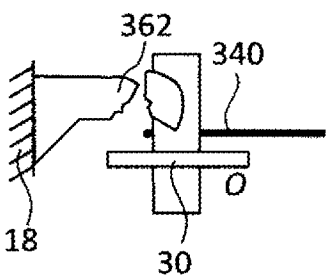
Fig. 7.b
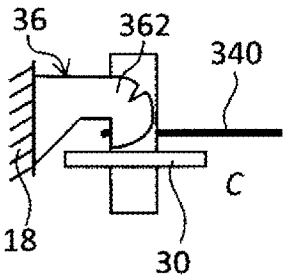
Fig. 7.a
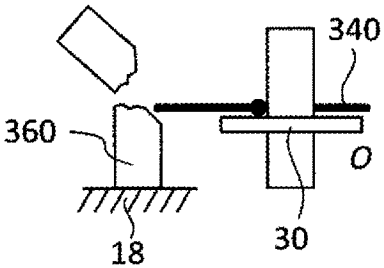
Fig. 5.b
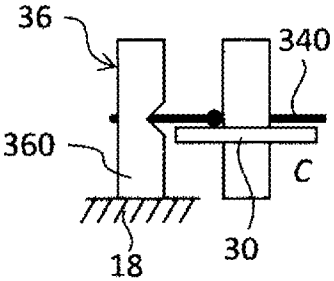
Fig. 5.a

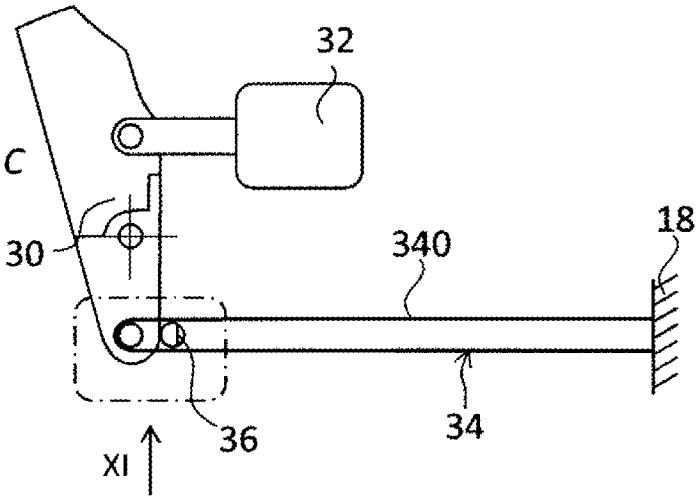
Fig. 10
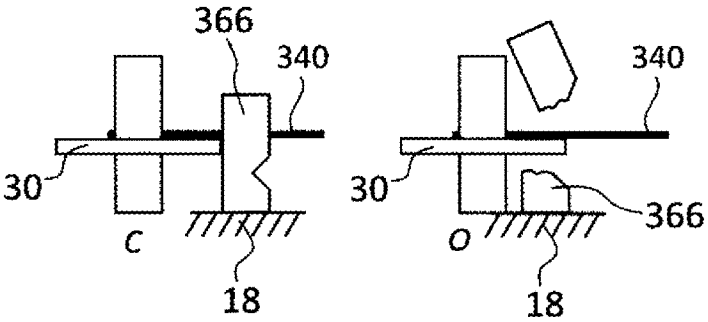
Fig. 11.b
Fig. 11.a
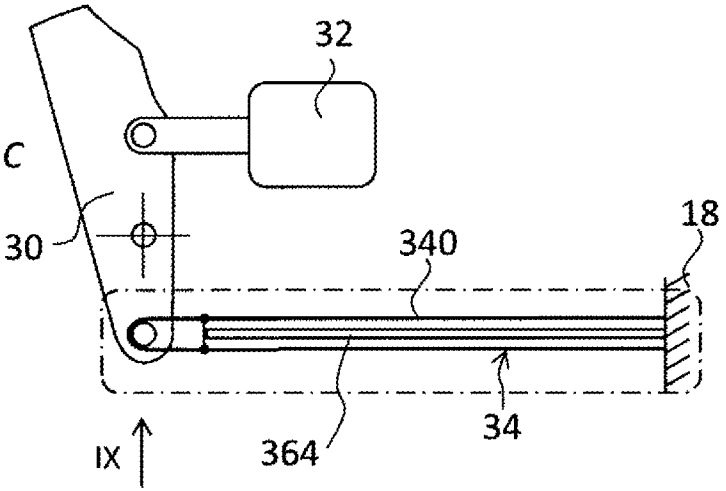
Fig. 8
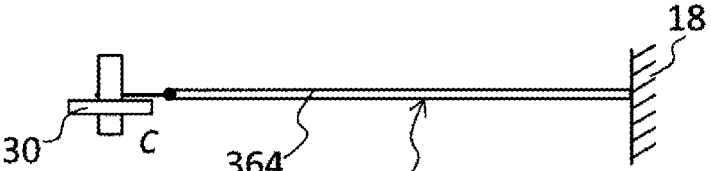
Fig. 9.a
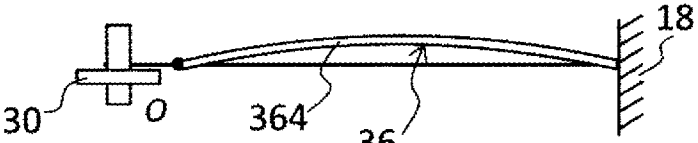
Fig. 9.b

LOCK WITH EMERGENCY ACTUATOR

CROSS-REFERENCE TO RELATED APPLICATIONS

The present application is the U.S. national stage of International Patent Application PCT/EP2016/056755 filed on Mar. 29, 2016 which, in turn, claims priority to Italian application MI2015A000467 filed on Apr. 1, 2015.

The present invention relates to a lock with an emergency actuator, in particular an electric lock for a vehicle.

In the following, reference will be made repeatedly to the automotive field, however it will be clear from the description that the invention can be easily used in other fields where a lock is needed for closing a door with respect to a frame.

Known locks used in the automotive field, comprise a lock body and a striker mounted respectively on the frame of the vehicle and on the door, or vice versa. In a manner known per se, such locks comprise a catch element pivotally mounted in the lock body. The catch element is suitable for rotating when, following the act of closing the door, it contacts the striker. In the rotated position the catch element firmly keeps the striker maintaining the door in the closed position.

Elastic means push the catch element from the keep position to the release position of the striker, while a lever stably maintains it in the keep position. For opening the lock it is sufficient to move the lever so that it does not engage any more the catch element and that it can rotate in the striker release position. Traditionally the movement of the lever is obtained through chains of kinematic couplings which mechanically brings the opening control in different positions which are comfortable for the user.

Electric locks are known in which the movement of the lever is obtained by means of a small electric motor comprised in the lock body. Such type of lock allows to eliminate all the chains of kinematic couplings of the mechanical controls, thus remarkably simplifying the lock as a whole.

However such electric locks are not without drawbacks, and this is the reason for their very limited diffusion.

The main problem deriving from the use of an electric lock relates to opening of the vehicle in emergency conditions. In normal use conditions, the force f which is needed for moving the lever is typically very small. Such force f can change depending on assembly accuracy, on mechanism lubrication and on other factors, but it is usually less than 30 N, and preferably less than 20 N.

After an impact like for example the one which occurs in an accident, the whole structure of the vehicle can undergo such deformations that the arrangement can change of the doors with respect to the frame. In such condition an increase can occur in the stresses between the different elements of the lock and, as a consequence, an increase in the friction forces. For this reason also the force needed for releasing the catch element remarkably increases. In-depth studies in this particular sector indicate that after an accident which is considered to be survivable, the force needed for moving the lever increases, in some cases up to 700 N. It is thus clear that the normal electric motor, designed for applying maximum forces of 30 N, is not able to allow the opening of the lock. Thus the absence of mechanical controls would imply the impossibility to open the lock, which condition is considered unacceptable.

It is known that the shape memory phenomenon consists in the fact that a mechanical piece made of an alloy that exhibits said phenomenon is capable of transitioning, upon a temperature change, between two shapes that are preset at the time of manufacturing of the mechanical piece. Such transitioning occurs in a very short time and without intermediate equilibrium positions. A first mode in which the phenomenon may occur is called "one-way" in that the mechanical piece can change shape in a single direction upon the temperature change, e.g. passing from shape A to shape B, whereas the reverse transition from shape B to shape A requires the application of a mechanical force.

On the contrary, in the so-called "two-way" mode both transitions can be caused by temperature changes, this being the case of the application of the present invention. This occurs thanks to the transformation of the micro-crystalline structure of the piece that passes from a type called martensitic (M), stable at lower temperatures, to a type called austenitic (A), stable at higher temperatures, and vice versa (M/A and A/M transition).

A Shape Memory Alloy wire (or SMA wire) has to be trained so that it can exhibit its features of shape memory element, and the pre-loading process of a SMA wire usually allows to induce in a highly repeatable manner a martensite/austenite (M/A) phase transition when the wire is heated and to induce an austenite/martensite (A/M) phase transition when the wire is cooled. In the M/A transition the wire undergoes a shortening.

In a manner well known per se, four characteristic temperatures can be identified in a transformation cycle of a SMA:

- $A_s$ is the temperature at which, while heating, transformation from martensite to austenite starts;
- $A_f$ is the temperature at which, while heating, transformation from martensite to austenite ends;
- $M_s$ is the temperature at which, while cooling, transformation from austenite to martensite starts; and
- $M_f$ is the temperature at which, while cooling, transformation from austenite to martensite ends.

EP 1 279 784 discloses an electric lock wherein the traditional electric motor for moving the lever is replaced by a SMA actuator. As reported above, such kind of alloys have, in a manner known per se, the peculiarity of changing their own shape as a consequence of the change of their temperature. According to such known solutions, the temperature of the SMA actuator can be easily and repeatedly increased by Joule effect, supplying a current to the SMA wire. However, even the solution of EP 1 279 784 is not without drawbacks. As a matter of fact, in this solution the SMA actuator is just intended to replace the electric motor, thus to generate a force of about 30 N, even if the SMA actuators per se are suitable for generating forces which are remarkably higher. Since the maximum force substantially depends on the diameter of the SMA wire which constitutes the actuator, in principle a SMA wire could be used having a sufficiently large diameter for obtaining also a higher force, up to 700 N. However larger diameters imply a higher thermal inertia of the SMA wire, i.e. a longer cooling time for bringing the actuator back to its initial condition. Since during such cooling time there is no possibility to close the door, the cooling time needs to be as short as possible and, accordingly, the diameter of the SMA wire cannot exceed the one needed for obtaining 30 N. Accordingly, also the solution of EP 1 279 784 lacks a reliable emergency actuator.

US 2010/00237632 discloses a latch assembly wherein a primary activation system lacking a mechanical connection to the passenger compartment is associated to an auxiliary activation mechanism that does not rely on the vehicle power system, i.e. the activation signal is caused by a key or a portable energy storage device. According to such known solution, a SMA mechanical component is coupled to the movable lever of the latch by means of a lever spring and it is suitable to the ordinary unlocking of the latch assembly, US 2010/00237632 is silent about the coupling of said latch assembly with a reliable emergency actuator.

EP 2845973 discloses an emergency actuator of a lock suitable to apply forces on a lever to release the catch after an accident. According to such known solution, a linear transmission element is physically interposed between the SMA element and the lever, having an extremity that is connected to said SMA element and the other extremity that is connected to said lever. The mechanical coupling among the SMA element and the lever is assured continuously in time and only by the presence of said linear transmission element, i.e. SMA element and the lever are never in direct contact with each other. Accordingly, EP 2845973 discloses in one of its embodiments that said linear transmission element can be destroyed after the SMA wire activation: as a matter of the fact the SMA element is mechanically connected to the lever till the fracture of the transmission element whereas it is disconnected after that fracture.

The object of the present invention is therefore to overcome at least partially the drawbacks reported above with respect to the prior art.

In particular, an aim of the present invention is to provide a lock with an emergency actuator which is at the same time simple, reliable and suitable for avoiding its accidental activation related to external thermal conditions.

Although specific reference is made in the following to the use of a wire as actuating member, it should be noted that what is being said also applies to other similar shapes with a dimension much greater than the other two dimensions which are generally very small, e.g. strips, strings, tapes and the like.

The object and the aim reported above are obtained by a lock according to claim 1.

Figure 1:
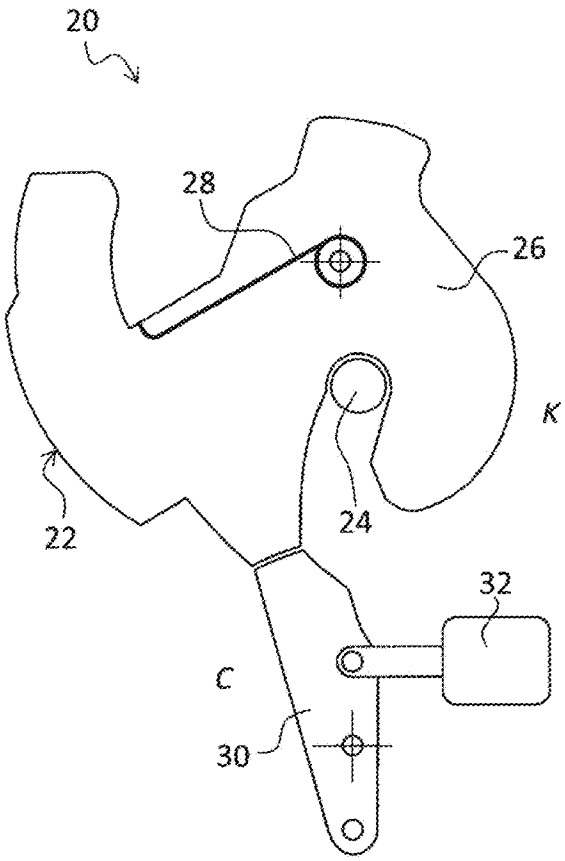
Fig. 1 PRIOR ART
Figure 3:
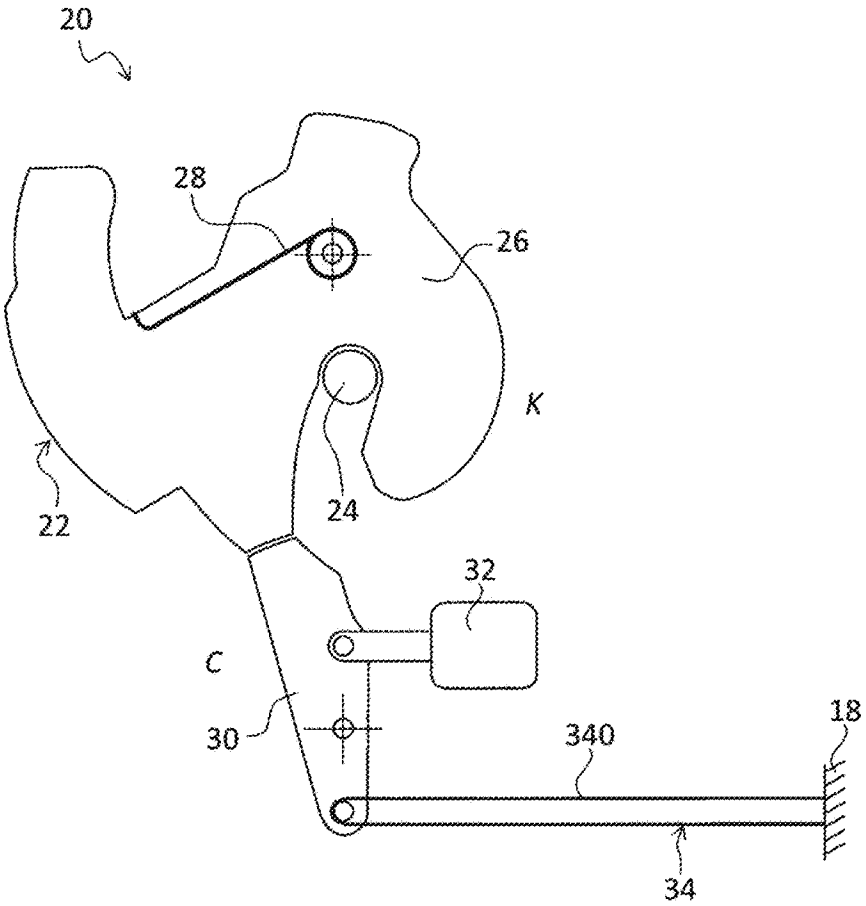
Fig. 3 PRIOR ART
Figure 12:
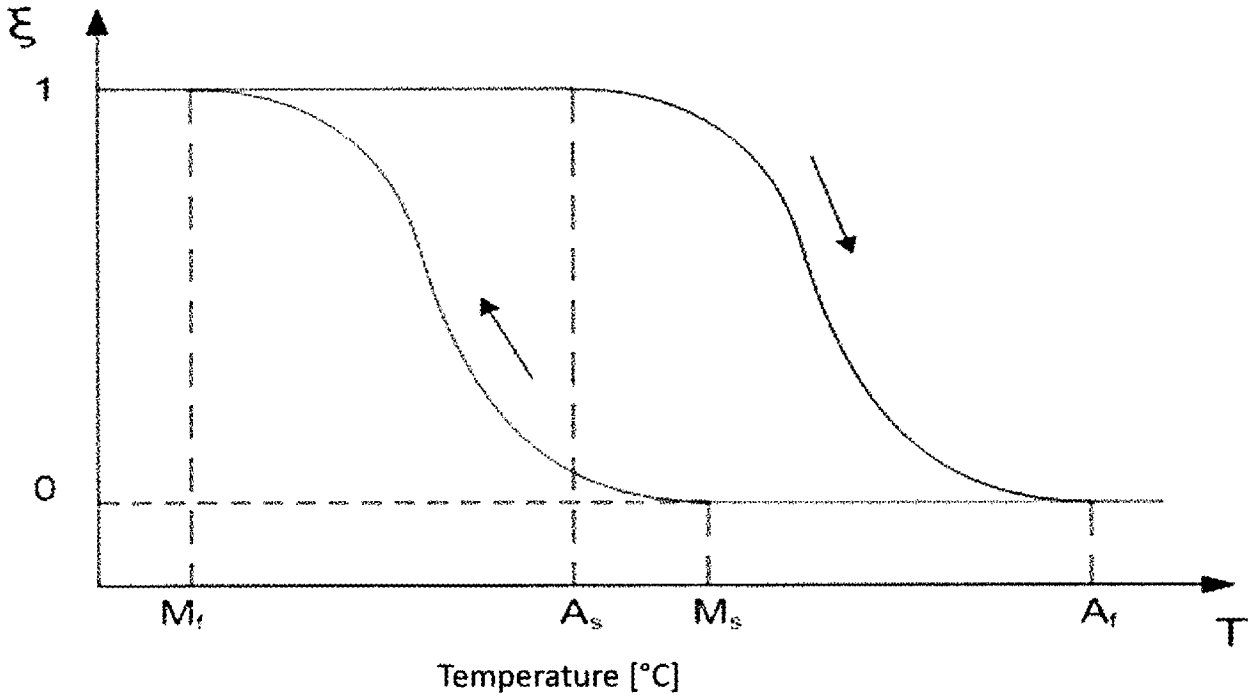

The further features and advantages of the invention will be clear from the description, reported herebelow, of some embodiments, given as examples and without any limitative intent with reference to the attached drawings in which:

FIG. 1 schematically shows a lock according to the prior art in a closed configuration;

FIG. 2 shows the lock of FIG. 1 in an open configuration;

FIG. 3 schematically shows a lock comprising a SMA wire according to the prior art in a closed configuration;

FIG. 4 schematically shows a particular of a first embodiment of the lock according to the invention;

FIG. 5.*a* schematically shows the detail indicated by V in FIG. 4, seen in the direction of the arrow;

FIG. 5.*b* shows the particular of FIG. 5.*a* after the action of the actuator;

FIG. 6 schematically shows a particular of a second embodiment of the lock according to the invention;

FIG. 7.*a* schematically shows the detail indicated by VII in FIG. 6, seen in the direction of the arrow;

FIG. 7.*b* shows the particular of FIG. 7.*a* after the action of the actuator;

FIG. 8 schematically shows a particular of a third embodiment of the lock according to the invention;

FIG. 9.*a* schematically shows the detail indicated by IX in FIG. 8, seen in the direction of the arrow;

FIG. 9.*b* shows the particular of FIG. 9.*a* after the action of the actuator;

FIG. 10 schematically shows a particular of a fourth embodiment of the lock according to the invention;

FIG. 11.*a* schematically shows the detail indicated by XI in FIG. 10, seen in the direction of the arrow;

FIG. 11.*b* shows the particular of FIG. 11.*a* after the action of the actuator; and FIG. 12 shows a diagram relating to some features of the shape memory alloys.

With reference to the attached figures, 20 indicates a lock as a whole for closing a door with respect to a frame 18. The lock 20 comprises lock body 22 and a striker 24, wherein the lock body 22 is mounted on the door and the striker 24 is mounted on the frame 18, or vice versa. The lock body 22 comprises:

- a catch element 26 mounted so as to rotate between a keep position K and a release position R of the striker 24;
- elastic means 28 suitable for driving the catch element 26 from the striker keep position K to the striker release position R;
- a lever 30 suitable for moving between two positions, a closing position C in which it maintains the catch element 26 in the striker keep position K and an opening position O in which it is disengaged from the catch element 26; and
- an service actuator 32 suitable for applying a force f on the lever 30 so as to bring it from the closing position C to the opening position O.

The lock body 22 further comprises an emergency SMA actuator 34 suitable for applying a force F on the lever 30 so as to bring it from the closing position C to the opening position O.

According to the invention, the SMA actuator 34 is designed in such a manner that it can apply a force F higher than 100 N.

According to a further aspect of the invention, the SMA actuator 34 comprises at least a blocking means 36, for example a detent, for allowing the force F to be applied on the lever 30 only when the force F exceeds a predetermined threshold value According to another aspect of the invention, the SMA actuator 34 comprises a SMA wire 340 made of a Nickel-Titanium alloy. Preferably the SMA wire 340 has a maximum section diameter greater than 0.5 mm, more preferably than 1.0 mm.

According to a possible embodiment of the invention, the SMA actuator 34 comprises a SMA wire 340 which is preferably designed in such a manner that its transformation temperature $A_s$ is higher than 80° C. Preferably the SMA wire 340, when the A/M transition take place, is able to reduce its length of at least 3.5% of the starting one.

In order to avoid the drawbacks of the known locks using SMA actuators, the applicant completely changed the approach to SMA actuators in electric locks. As a matter of fact, according to the present invention, the SMA actuator 34 is intended for emergency conditions only, while usually the lever 30 is moved by another service actuator 32 and the SMA wire is able to exert a force suitable to actuate the lever 30 only after fracture or sudden deformation of the blocking means that is mechanically coupled to said SMA wire.

As reported above, the SMA actuator 34 can apply a force F higher than 100 N. Advantageously the SMA actuator 34 is designed for applying forces F remarkably higher than 100 N, preferably higher than 350 N, and even more preferably of about 700 N. As the skilled person can easily understand from this description, such SMA actuator 34, designed for generating a force F of 700 N, needs necessarily a large diameter SMA wire 340 having a high thermal inertia. However, according to the present invention, this is not a problem since the SMA actuator 34 is intended for emergency only, when there is no urgent need of closing the doors. On the contrary, during normal use, the opening of the lock 20 is assigned to the service actuator 32.

The service actuator 32 can comprise either a conventional electric motor or another SMA actuator, provided that the latter is designed for generating forces of about 30 N and for having a very reduced thermal inertia.

This arrangement according to the invention permits to obtain a very simple lock 20 which is reliable in use both under normal and under emergency conditions.

A particular property of the SMAs is that the transformation temperatures change according to the stress/strain state of the material. Specific reference is made here to the diagram of FIG. 12 where represents $\xi$ the martensite fraction and T represents temperature, and to the explanation about the transformation temperatures $A_s$, $A_f$, $M_s$, $M_f$ reported above.

Once a wire is obtained from a SMA of a defined composition and subjected to a selected training process, the transformation temperatures are also defined.

Such property has been exploited by the applicant for obtaining a SMA actuator 34 which does not activate spontaneously under particular environmental conditions like long exposition of the vehicle to solar irradiation.

According to some embodiments of the invention, the SMA wire 340 from which the SMA actuator 34 is obtained, is chemically selected and/or trained so as to increase its $A_s$ up to at least 80° C. or more. According to this aspect of the invention, it is possible to design the actual transformation temperature $A_s$ of the actuator 34 in order to avoid any undesired opening of the doors during normal use of the vehicle, even in extreme environmental conditions. For example the transformation temperature $A_s$ of the SMA actuator 34 can be set at about 80° C. or higher.

Moreover, a further increase in $A_s$ can be obtained by submitting the wire 340 to a tensile stress condition while assembling the SMA actuator 34. In this manner, the temperature $A_s$ can be further increased, even up to 150° C.

As already reported above, the SMA actuator 34 comprises a blocking means, e.g. in the form of a detent 36, which can be adapted to maintain the wire 340 in a pre-elongated state. Said pre-elongated state of the SMA wire can be obtained by a design free of any tensile condition, obtainable as result from plastic deformations prior to the installation of the shape memory alloy in the lock, or by a design in which the SMA wire is in a tensile stress condition as effect of the mechanical coupling to said detent 36. The detent 36 is also suitable for allowing the force F to be applied on the lever 30 only when the force F exceeds a predetermined threshold value. As a matter of fact, the detent 36 is designed, in a manner know per se, for opposing the force F applied by the wire 340 up to a pre-determined threshold value. While the force F of the wire 340 remains under such threshold value, the detent 36 prevents the force F itself from reaching the lever 30 of the lock 20. Once the force reaches such threshold value, the detent suddenly interrupts its opposing action thus allowing the force F to reach the lever 30 so as to rotate it. Some possible embodiments using this particular solution will be disclosed below, with specific reference to FIGS. 4 to 11.

The detent 36 can comprise a sacrificial element or a peak-load component, which will be disclosed in greater detail below. Although specific reference is made in the drawings to the use of a SMA wire in a U-shape or V-shape design, it should be noted that what is being said also applies to other shapes suitable to be used as traction mean in a mechanical actuating device.

FIGS. 4 and 5 show a detent 36 comprising a front pin 360 which is designed so as to break when its stress state reaches a threshold value. For example the pin 360 can be weakened in a controlled manner by means of a notch. During normal use of the vehicle, the pin 360 prevents any force F from reaching the lever 30 of the lock 20 (see FIG. 5.*a*). Under emergency conditions, the SMA actuator 34 is activated and its force F increases up to the threshold value at which the pin 360 breaks (see FIG. 5.*b*). Once the pin 360 is broken, the force F reaches the lever 30, thus opening the lock 20.

FIGS. 6 and 7 show a detent 36 comprising a hook 362 which is designed so as to break when its stress state reaches a threshold value. For example the hook 362 can be weakened in a controlled manner by means of a notch. During normal use of the vehicle, the hook 362 prevents any force F from reaching the lever 30 of the lock 20 (see FIG. 7.*a*). Under emergency conditions, the SMA actuator 34 is activated and its force F increases up to the threshold value at which the hook 362 breaks (see FIG. 7.*b*). Once the hook 362 is broken, the force F reaches the lever 30, thus opening the lock 20.

FIGS. 8 and 9 show a detent 36 comprising a slender rod 364 which is designed so as to undergo buckling when its compression state reaches a threshold value. As the skilled person knows, buckling is a sudden deformation which instantly leads the slender rod 364 to lose its load-carrying capacity. During normal use of the vehicle, the slender rod 364 prevents any force F from reaching the lever 30 of the lock 20 (see FIG. 9.*a*). Under emergency conditions, the SMA actuator 34 is activated and its force F increases up to the threshold value at which the slender rod 364 undergoes buckling (see FIG. 9.*b*). Once the slender rod 364 is bent, the force F reaches the lever 30, thus opening the lock 20.

In the embodiments of FIGS. 4 to 9, the detent 36 is arranged in such a manner that the lever 30 can freely rotate in its normal use without any interference.

FIGS. 10 and 11 show a detent 36 comprising a back pin 366 which is designed so as to break when its stress state reaches a threshold value. For example the pin 366 can be weakened in a controlled manner by means of a notch. During normal use of the vehicle, the pin 366 prevents any force F from reaching the lever 30 of the lock 20 (see FIG. 11.*a*). Under emergency conditions, the SMA actuator 34 is activated and its force F increases up to the threshold value at which the pin 366 breaks (see FIG. 11.*b*). Once the pin 366 is broken, the force F reaches the lever 30, thus opening the lock 20. It is to be noted here that the embodiment of FIGS. 10 and 11, the detent 36 is arranged in such a manner that a solid lever 30 could not rotate freely in its normal use because of interference with the pin 366 itself. Accordingly, in this specific embodiment, the lever 30 is articulated so as to separate the normal movement originated by the service actuator 32 from the emergency movement originated by the SMA actuator 34.

From the above description it is clear for the skilled person that, with particular reference to the embodiment comprising a detent in form of sacrificial elements (front pin 360, hook 362, back pin 366) or, to some extent, even a peak-load component (slender rod 364), the SMA actuator 34 is structurally limited to one use only. Since the SMA actuator 34 is not intended for normal use but for emergency only, this is not a problem.

According to some safety solution, after an accident is detected by the vehicle on-board sensors, the power supply from the main battery of the vehicle can be switched-off in order to avoid free sparks and/or electric shocks.

In these cases, the lock 20 according to the invention can also comprise an independent power supply, for example an auxiliary battery or a capacitor. According to other possible embodiments, the lock 20 can comprise other non-electric heating systems, like for example a cartridge comprising a pyrotechnic composition or the like.

As the skilled person can easily appreciate from the above description, the lock 20 according to the invention obtains its object, i.e to overcome at least partially the drawbacks reported above with respect to the prior art.

In particular, the present invention provides a lock 20 with an emergency actuator 34 which is at the same time simple and reliable. Moreover the emergency actuator 34 of the invention is suitable for avoiding its accidental activation related to external thermal conditions.

With regard to the above-described embodiments of the lock 20, the person skilled in the art may, in order to satisfy specific requirements, make modifications to and/or replace elements described with equivalent elements, without thereby departing from the scope of the accompanying claims.

The invention claimed is:

1. A lock for closing a door with respect to a frame, comprising a lock body and a striker, wherein the lock body is mounted on the door and the striker is mounted on the frame, or vice versa, wherein the lock body comprises:

a catch element mounted so as to rotate between a striker keep position and a striker release position;

elastic means suitable for driving the catch element from the striker keep position to the striker release position;

a lever suitable for moving between a closing position in which the lever maintains the catch element in the striker keep position and an opening position in which the lever is disengaged from the catch element;

a service actuator suitable for applying a service actuator force on the lever to bring the lever from the closing position to the opening position;

wherein the lock body further comprises a shape memory alloy actuator with a shape memory alloy wire suitable for applying a shape memory alloy wire force directly on the lever so as to bring the lever from the closing position to the opening position, wherein the shape memory alloy actuator is configured to apply a shape memory alloy wire force higher than 100 N, wherein the shape memory alloy actuator comprises a detent for allowing the shape memory alloy wire force to be applied on the lever only when the shape memory alloy wire force exceeds a predetermined threshold value as effect of a fracture or sudden deformation of said detent, and wherein the detent comprises a hook designed to break in an emergency condition, thus the detent being irreversibly damaged in an emergency condition.

2. The lock according to claim 1, wherein the shape memory alloy wire is made of a Nickel-Titanium alloy.

3. The lock according to claim 2, wherein the shape memory alloy wire has a maximum section diameter greater than 0.5 mm.

4. The lock according to claim 2, wherein the shape memory alloy wire has a transformation temperature equal to or higher than 80° C.

5. The lock according to claim 2, wherein the shape memory alloy wire is mounted free of any tensile stress.

6. The lock according to claim 2 wherein the shape memory alloy wire exhibits, following its phase transition, a length reduction of at least 3.5%.

7. The lock according to claim 2 wherein the shape memory alloy wire is mounted with a U-shape or V-shape.

8. The lock according to claim 2, wherein the shape memory alloy wire is coupled to said detent in such a way that said detent maintains the shape memory alloy wire in a tensile stress condition.

9. The lock according to claim 1, wherein the shape memory alloy actuator is configured to apply a shape memory alloy wire force higher than 350 N.

10. The lock according to claim 1, wherein said detent comprises a sacrificial element or a peak-load component.

11. A lock, comprising:

a striker; and a lock body having a catch element mounted so as to rotate between a striker keep position and a striker release position, elastic means suitable for driving the catch element from the striker keep position to the striker release position, a lever suitable for moving between a closing position in which the lever maintains the catch element in the striker keep position and an opening position in which the lever is disengaged from the catch element, and a service actuator suitable for applying a service actuator force on the lever to bring the lever from the closing position to the opening position, wherein the lock body further comprises a shape memory alloy actuator with a shape memory alloy wire suitable for applying a shape memory alloy wire force directly on the lever so as to bring the lever from the closing position to the opening position, wherein the shape memory alloy actuator is configured to apply a shape memory alloy wire force higher than 100 N, wherein the shape memory alloy actuator comprises blocking means for allowing the shape memory alloy wire force to be applied on the lever only when the shape memory alloy wire force exceeds a predetermined threshold value as effect of a fracture or sudden deformation of said blocking means, and wherein the blocking means comprises a hook designed to break in an emergency condition, thus the blocking means being irreversibly damaged in an emergency condition.

* * * * *